US006488544B1

(12) United States Patent
Hyland

(10) Patent No.: US 6,488,544 B1
(45) Date of Patent: Dec. 3, 2002

(54) ANTI CROSSTALK ELECTRICAL CONNECTOR AND METHOD OF MANUFACTURING THE SAME

(75) Inventor: James Hyland, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/040,754

(22) Filed: Dec. 28, 2001

Related U.S. Application Data

(63) Continuation-in-part of application No. 09/863,942, filed on May 22, 2001.

(51) Int. Cl.[7] ..... H01R 24/00
(52) U.S. Cl. ..... 439/676; 439/941
(58) Field of Search ..... 439/676, 941

(56) References Cited

U.S. PATENT DOCUMENTS 5,624,274 A * 4/1997 Lin ..... 439/417
5,947,772 A * 9/1999 Arnett et al. ..... 439/676

* cited by examiner

*Primary Examiner*—Tho D. Ta
*Assistant Examiner*—Truc Nguyen
(74) *Attorney, Agent, or Firm*—Wei Te Chung

(57) ABSTRACT

An electrical connector of the present invention includes an insulative housing (10) and a contact insert (12) attached to the housing. The contact insert includes eight singnal contacts (26*a*–26*h*) and two grounding contacts (28*a*, 28*b*) arranged side by side and an upper printed substrate (30) and a lower printed substrate (32) sandwiching the singnal contacts and the grounding contacts therebetween. Two selected singnal contacts (26*c*, 26*f*) each are severed into three pieces but the other contacts (26*a*, 26*b*, 26*d*, 26*e*, 26*g*, and 26*h*) are not severed. Two end portions (58*a*, 58*b*; 56*a*, 56*b*) of the severed contacts are re-routed by conductive traces on the upper lower printed substrates, while the middle portions (58*c*, 56*c*) are grounded. Therefore, lengths inducing electrical capacitances between the severed contacts and the adjacent contacts can be reasonably reduced, thereby reducing crosstalk between the severed contacts and the adjacent contacts.

17 Claims, 14 Drawing Sheets

32

32

ANTI CROSSTALK ELECTRICAL CONNECTOR AND METHOD OF MANUFACTURING THE SAME

CROSS-REFERENCES TO RELATED APPLICATIONS

This application is a Continuation-In-Part (CIP) application of co-pending application Ser. No. 09/863,942, filed on May 22, 2001.

BACKGROUND OF THE INVENTION

1. Field of the Invention

The present invention relates to an RJ modular connector, and more particularly to an RJ modular connector having a printed circuit board (PCB) provided therein to reduce crosstalk between terminals.

2. Description of Related Art

RJ modular connector has been widely used in telecommunication system since it was firstly created. A so-called RJ45 modular connector is a typical example for this kind of connector.

The RJ45 modular connector includes a total of eight terminals. Resulting from miniaturization of the computer, all corresponding components, including connectors, have to be reduced as to their dimension and size. One of the negative consequences or problems created from miniaturization is crosstalk between terminals. When the RJ connector is used in low speed signal transmission, the crosstalk between adjacent terminals can be ignored in light of its effect. However, when the RJ connector is used for high-speed signal transmission, the crosstalk between adjacent terminals creates a great problem. Unless the crosstalk can be effectively controlled within an accepted level, it is unlikely that the RJ 45 modular connector can be used in the high-speed signal transmission.

One of the approaches is to select a pair of terminals as a differential pair. In the differential pair, two terminals transmit the same signal of opposite polarity. By this arrangement, a majority of the noise received between the two terminals of a differential pair can be subtracted in a data processing unit.

There are at least eight different standards having reference in selecting terminals as differential pairs namely T568A, T568B, USOC 4-pair, USOC 1-, 2- or 3-pair, 10BASE-T (802.3), Token Ring (802.5), 3-pair (MMJ), and TP-PMD (X3T9.5) and ATM. In each implementation, two terminals are selected as a pair in which some are close to each other, while some are apart from each other. Each pattern has its own uniqueness, while each also carries a crosstalk issue that needs to be solved.

Among those standards, T568A and T568B are widely used and in T568A, terminals 1, 2 configure 3rd pair, terminals 3, 6 configure 2nd pair, terminals 4, 5 configure 1st pair, while terminals 7, 8 configure 4th pair. In T568B, terminals 1, 2 configure 2nd pair, terminals 3, 6 configure 3rd pair, terminals 4, 5 configure 1st pair, while terminals 7, 8 configure 4th pair.

Since those eight terminals are equally spaced, electrical capacitances between terminals will surely create some problems, i.e. crosstalk. For example, terminal 3 will naturally pick up energy induced from terminals 2 and 4 which are close to terminal 3. On the other hand, terminal 6, which carries signal having inverted phase of the signal carried by terminal 3, will also pick up energy induced from terminals 5 and 7. However, energy induced into terminals 3, 6 from terminals 2 and 7 can not be suitably eliminated because terminals 3, 6 is unlikely to establish equal capacitances between terminal 1 and terminal 8 to balance the capacitances between terminals 2, 3 and 6, 7. Accordingly, signals transmitted by terminals 3, 6 carry noises generated by their adjacent terminals 2, 7. In addition, terminals 3 and 6 will also carry noises induced thereto from terminals 4, 5 and which capacitances should be also carefully taken to avoid certain noises.

In order to decrease the effects of electrical capacitance between the (3rd, 4th) and (3rd, 2nd) terminals, and (6th, 5th) and (6th, 7th) terminals, many approaches have been provided, such as creating electrical capacitances between 3rd and 1st terminals and 3rd and 5th terminals, to balance the electrical capacitance between the 3rd and 2nd terminals and 3rd and 4th terminals, and creating electrical capacitance between 6th and 8th terminals and 6th and 4th terminals to balance the electrical capacitances between the 6th and 7th terminals and 6th and 5th terminals.

To solve the above issue, the terminals should be rearranged or new electrical capacitances should be added.

one known solution is to have 6th and 2nd terminals arranged in the first layer, while 8th, 5th, 4th, and 1st terminals are arranged in the second layer, and 7th and 3rd terminals are arranged in the third layer.

The 6th terminal in the first layer has a rectangular loop having its longitudinal sides aligned with terminals 4th and 8th located in the second layer, while terminal 3 in the third layer also has a rectangular loop having its longitudinal sides aligned with terminals 5th and 1st located in the second layer.

In addition, the right longitudinal loop side of the terminal 6th further includes a square corresponding to a square formed in terminal 4th. The left longitudinal loop side of the terminal 3 includes also a square with respect to the square formed on terminal 5th.

The above arrangements are to increase the capacitances between (1st, 3rd), (3rd, 5th), and (4th, 6th), (6th, 8th) terminals thereby helping to balance electrical capacitances of the terminals.

However, those eight or four sets of terminals are arranged in three different layers, and each set of terminals are separately divided by an insulative sheet material. U.S. Pat. No. 5,769,647 of Tulley et al. discloses such structure. This will no doubt increase the complexity of the connector.

In addition, there are different shapes and configurations among those eight terminals. Each terminal has its own shape which is different from each other, especially the 3rd and 6th terminals, each including the rectangular loop portion which overlaps to corresponding terminals to create desired electrical couplings. Each loop further forms the square to increase the electrical capacitances with corresponding terminals having the square. The electrical capacitances created can help to meet higher system requirements. The eight different configurations of the terminals will surely increase the difficulty and complexity in production.

There are some other approaches that include routing terminal tails of those 3rd, 6th and 4th, 5th terminals to alter their position and affect capacitances between 3rd, 2nd and 3rd, 4th; and 6th, 5th, and 6th, 7th terminals. However routing terminal tails will inevitably increase the manufacturing cost.

U.S. Pat. No. 6,120,329 of Steinman discloses another approach to solve the above-addressed problem. Again, terminals are configured with different shapes and dimensions making the production complex.

U.S. Pat. No. 5,069,641 of Sakamoto et al. discloses a suggestion of using substrate in the RJ modular housing; however, it addresses different issues.

SUMMARY OF THE INVENTION

A first object of this invention is to provide an RJ modular connector, and more particularly to an RJ modular connector having a printed circuit board (PCB) with conductive traces thereon to reduce crosstalk between contacts thereof.

A second object of this invention is to provide a method of manufacturing the above RJ modular connector.

A third object of the present invention is to provide a method of reducing crosstalk between contacts of an RJ modular connector.

To obtain the above objects, an RJ connector includes an insulative housing and a contact insert attached to the housing. The contact insert includes eight signal contacts and two grounding contact arranged side by side and an upper printed substrate and a lower printed substrate sandwiching the signal contacts and the grounding contacts therebetween. There is a grounded conductive material between at least two selected adjacent signal contacts for reducing capacitance between the two selected adjacent signal contacts.

As a second aspect of this invention, at least one selected signal contact is severed into pieces and two of the pieces are re-routed by conductive traces on a printed circuit board (PCB) but adjacent contacts are not severed. Therefore, length inducing electrical capacitance between the severed contact and the adjacent contacts can be reasonably reduced, thereby reducing crosstalk between the severed contact and the adjacent contacts.

As a third aspect of this invention, at least one selected signal contact is severed into three pieces and two end portions of the pieces are re-routed by conductive traces on a printed circuit board (PCB) and the middle portion is connected to a grounding trace. Therefore, the middle portion can provide grounding contact function to the severed and the adjacent signal contacts, thereby reducing crosstalk between the severed contact and the adjacent contacts.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
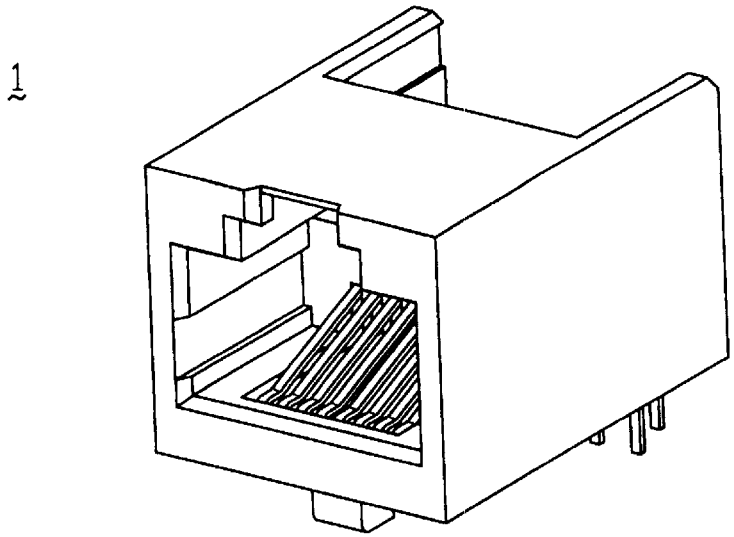
FIG. 1 is a front perspective view of a modular jack connector of the present invention.
Figure 2:
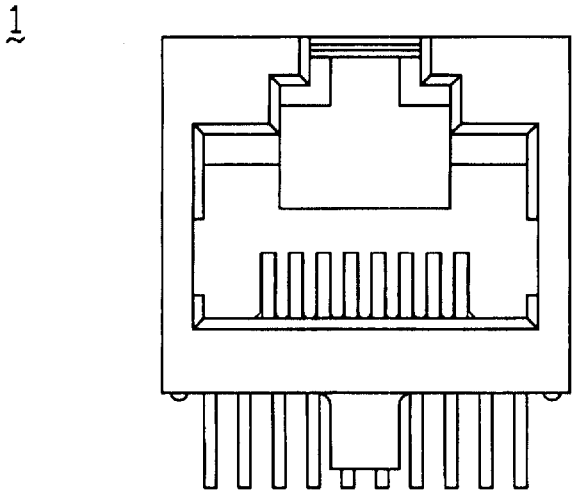
FIG. 2 is front planar view of FIG. 1.
Figure 3:
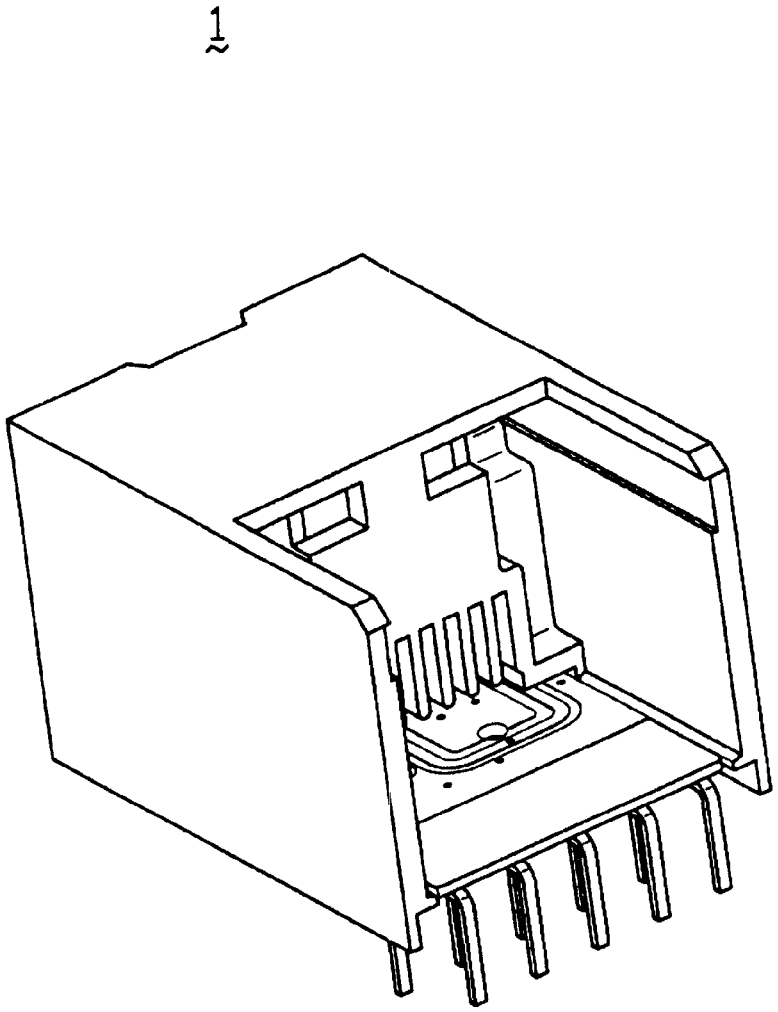
FIG. 3 is a rear perspective view of the modular jack connector shown in FIG. 1.

Referring to FIGS. 1, 2 and 3, an electrical connector 1 in accordance with the present invention is illustrated from front and back perspectives.

Figure 4:
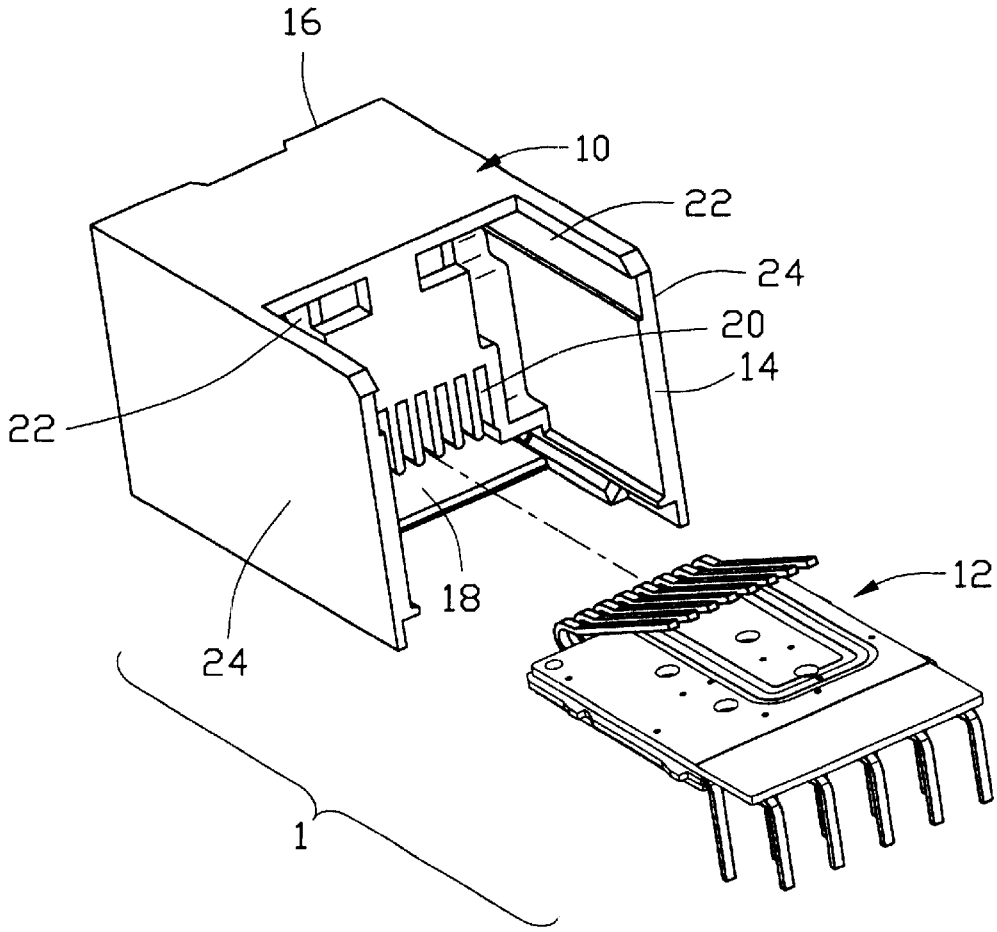
FIG. 4 is a view similar to FIG. 3 except that a contact insert of the connector is disassembled from a housing.

Referring to FIG. 4, the connector 1 includes an insulative housing 10 and a contact insert 12 attached to the housing 10 from a back 14 of the housing 1. The housing defines a chamber 18 through the back 14 and a front 16 of the housing 10 for engageably receiving the contact insert 12 therein. Above the chamber 18, there are eight slots 20 isolated from each other except for bottom sections thereof communicating with the chamber 18 for receiving respective contacts (described later) of the contact insert 12. Further above the chamber 18, there are two channels 22 adjacent to respective two opposite side walls 24 of the housing 10 for engageably receiving two Light Emitting Diodes (LEDs) therein.

In the upcoming paragraphs, the configuration of the contact insert 12 will be illustrated in great detail, which illustrates the core of the present invention.

Figure 5:
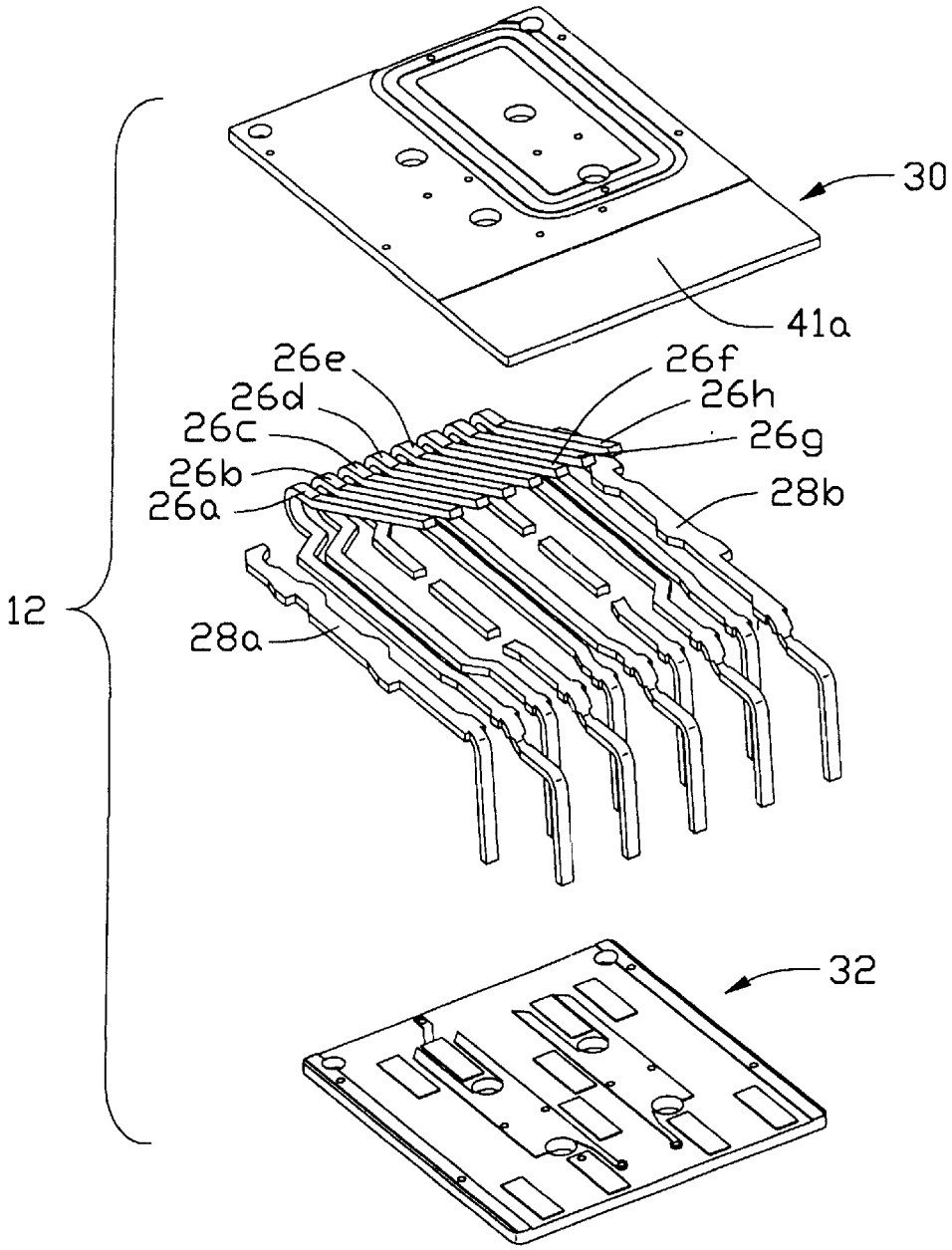
FIG. 5 is an exploded perspective view of the contact insert shown in FIG. 4.

Referring to FIG. 5, the contact insert 12 generally includes eight signal contacts, designated by 26*a*, 26*b*, 26*c*, 26*d*, 26*e*, 26*f*, 26*g* and 26*h*, two grounding contacts, designated by 28*a* and 28*b*, and an upper printed substrate 30 and a lower substrate 32 sandwiching the eight signal contacts and the two grounding contacts therebetween. The signal contacts 26*a* and 26*b* are differential contacts that transmit simultaneous signals of opposite polarity. The signal contacts 26*d* and 26*e*, 26*c* and 26*f*, 26*g* and 26*h* are all differential contacts, and such arrangement is illustrated in the FIG. 3(*a*) of the U.S. Pat. No. 5,941,734, issued to Matsushita Electric Works, Ltd. As shown in FIG. 5, a very important feature of the present invention is that the contacts 26*c* and 26*f* each are broken into three pieces, which will be illustrated in great detail later.

Figure 6:
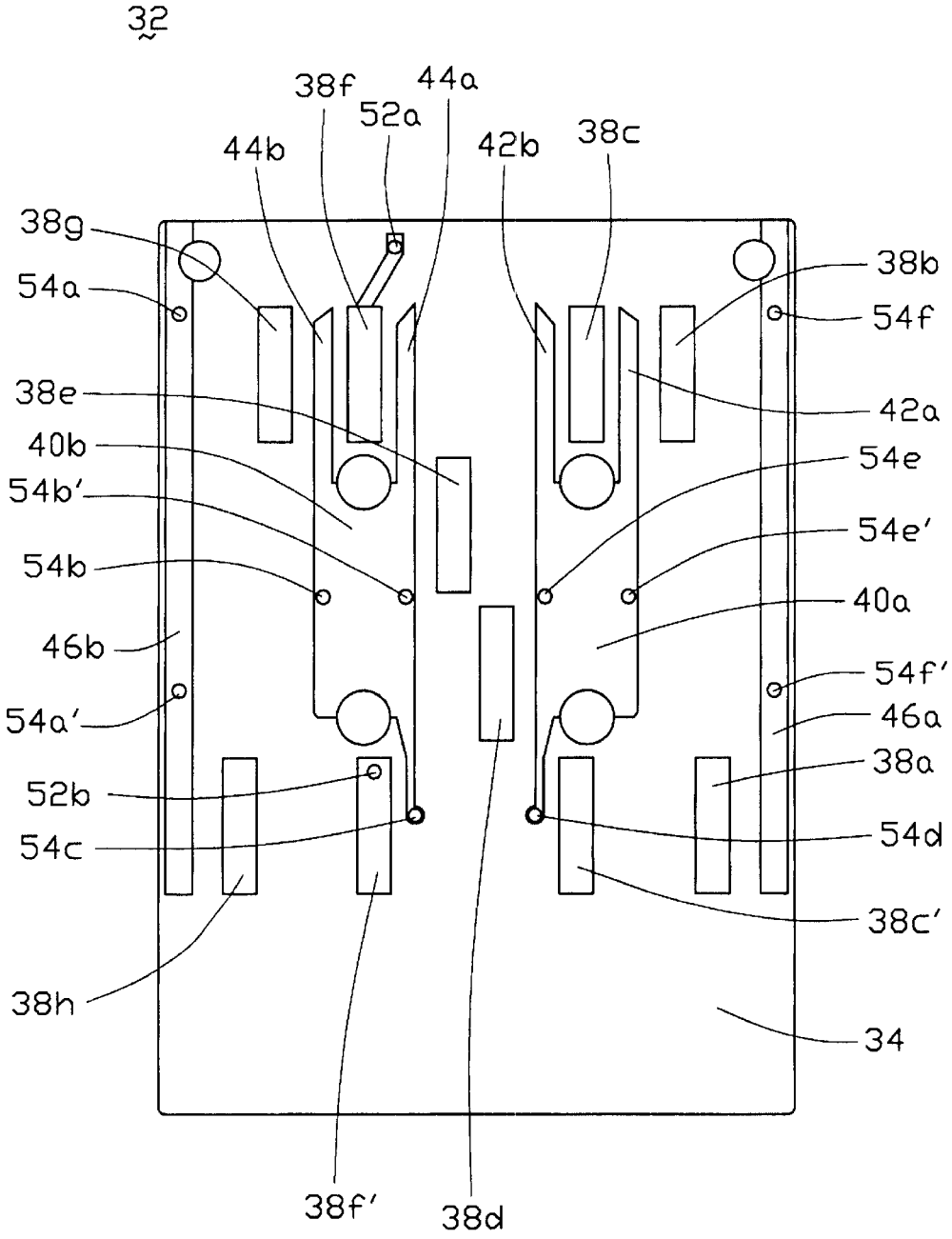
FIGS. 6 and 7 are planar view of opposite surfaces of an upper printed substrate.
Figure 7:
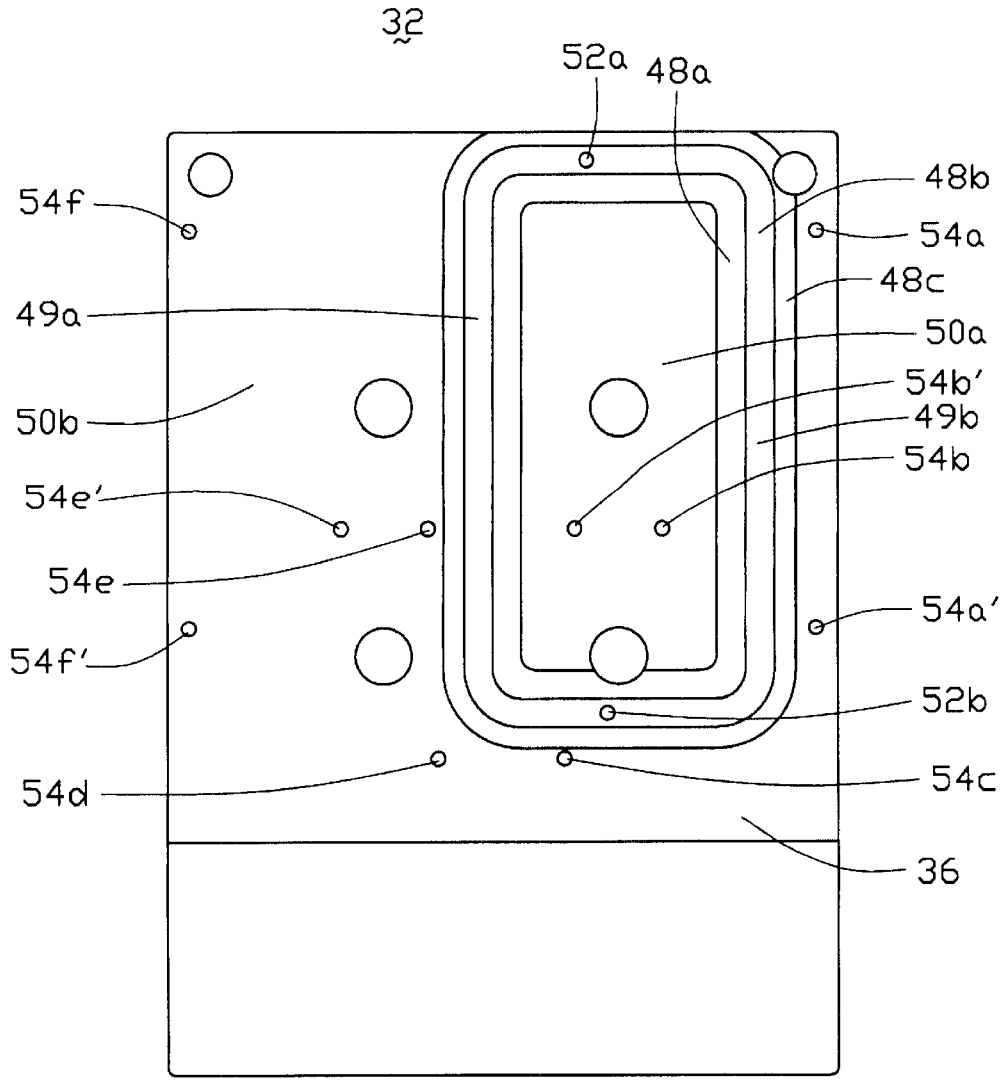

Referring to FIGS. 6 and 7, the upper printed substrate 30 has a first surface 34 and an opposite second surface 36. On the first surface 34, there are ten solder pads, generally designated by labels 38*a*, 38*b*, 38*c*, 38*c*', 38*d*, 38*e*, 38*f*, 38*f*', 38*g* and 38*h*, for electrically connecting the respective signal contacts 26*a*, 26*b* . . . 26*h*, wherein the solder pads 38*c* and 38*c*' connect the signal contact 26*c* and the solder pads 38*f* and 38*f*' connect the signal contact 26*f*. The solder pads 38*a*, 38*b*, 38*c*, 38*d*, 38*e*, 38*f*, 38*g* and 38*f* are arranged side by side and are staggered along the two perpendicular directions of the first surface 34 except that the solder pad 38*c*' generally locates at a same line with the solder pad 38*c*, and the solder pad 38*f*' generally locates at a same line with the solder pad 38*f*. Between the solder pads 38*c* and 38*c*' is a block of conductive plate 40*a* which has a width wider than the solder pad 38*c* and has two pieces 42*a*, 42*b* extending to be located respectively at opposite sides of the solder pad 38*c*. Between the solder pads 38*f* and 38*f*' is a block of conductive plate 40*b* which is a mirror of the conductive plate 40*a*. The conductive plate 40*b* has two pieces 44*a* and 44*b* positioned at two opposite sides of the solder pad 38*f*. There are two conductive bars 46*a* and 46*b* mounted on the first surface 34 and adjacent to opposite sides of the upper printed substrate 30.

On the second surface 36, there are three continuous loops, respectively designated by an inner loop 48*a*, a middle loop 48*b* and an outer loop 48*c*. Both the inner loop 48*a* and the outer loop 48*c* are insulative while the middle loop 48*b* is conductive. There are a first conductive panel 50*a* surrounded by the inner loop 48*a* and a second conductive panel 50*b* out of the outer loop 48*c* on the second surface 36.

There are a plurality of dots which are actually conductive vias traveling through the upper printed substrate 30 for electrically connecting the conductive elements on the first surface 34 to the conductive elements on the second surface 36. Two of the conductive vias, designated by 52*a* and 52*b*, are located on the middle loop 48*b* and respectively connect with the solder pads 38*f* and 38*f*', thereby establishing a conductive route from the solder pads 38*f* through the via 52*a*, the middle loop 48*b* and the via 52*b* to the solder pad 38*f*'. It is clearly shown in FIG. 7 that the middle loop 48*b* has a first side section 49*a* and a second side section 49*b* respectively disposed to be in spatial registry with the solder pads 38*d*, 38*h* for purpose described later. The other vias, designated by 54*a*, 54*a*', 54*b*, 54*b*', 54*c*, 54*d*, 54*e*, 54*e*', 54*f* and 54*f*', electrically connecting the conductive bars 46*a*, 46*b* and the conductive plates 40*a*, 40*b* together through the conductive panels 50*a*, 50*b*, thereby establishing a conductive route from the conductive panel 50*a* through the vias 54*b*, 54*b*', the conductive plates 40*b*, the via 54*c*, the conductive panel 50*b*, the vias 54*a*, 54*a*', 54*f* and 54*f*', to the conductive bars 46*a*, 46*b*, and a conductive route from the conductive plate 40*a* through the vias 54*e*, 54*e*' and 54*d*, the conductive panel 50*b* and the vias 54*a*, 54*a*', 54*f* and 54*f*', to the conductive bars 46*a*, 46*b*. The conductive panels 50*a*, 50*b* may provide EMI shielding function when the conductive bars 46*a*, 46*b* are grounded.

Figure 8:
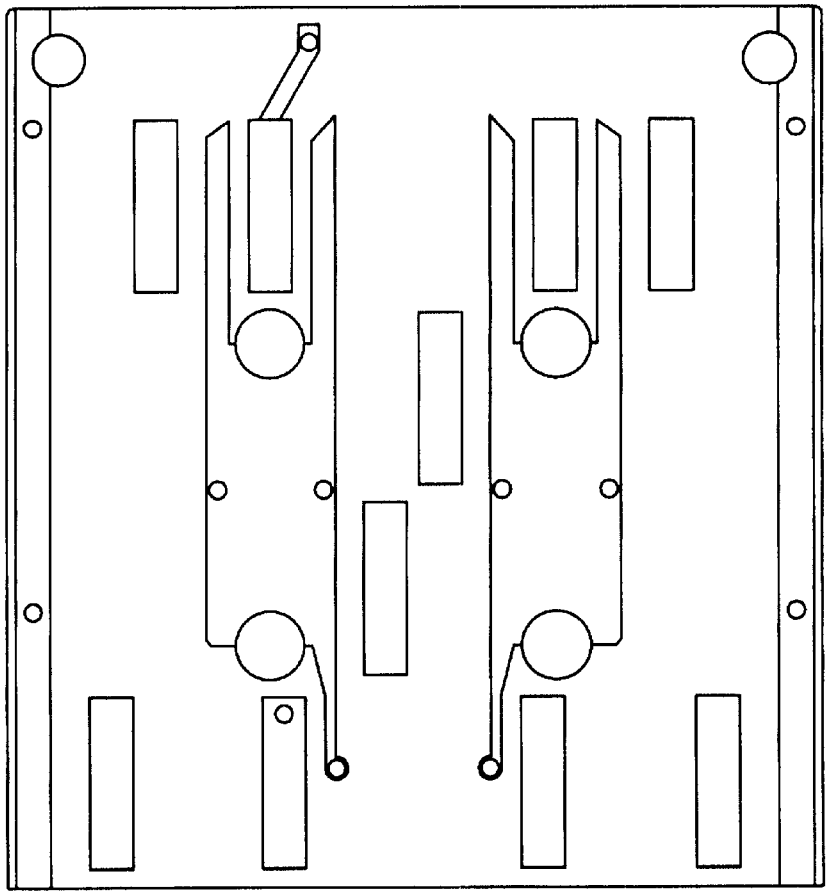
FIGS. 8 and 9 are planar view of opposite surfaces of a lower printed substrate.
Figure 9:
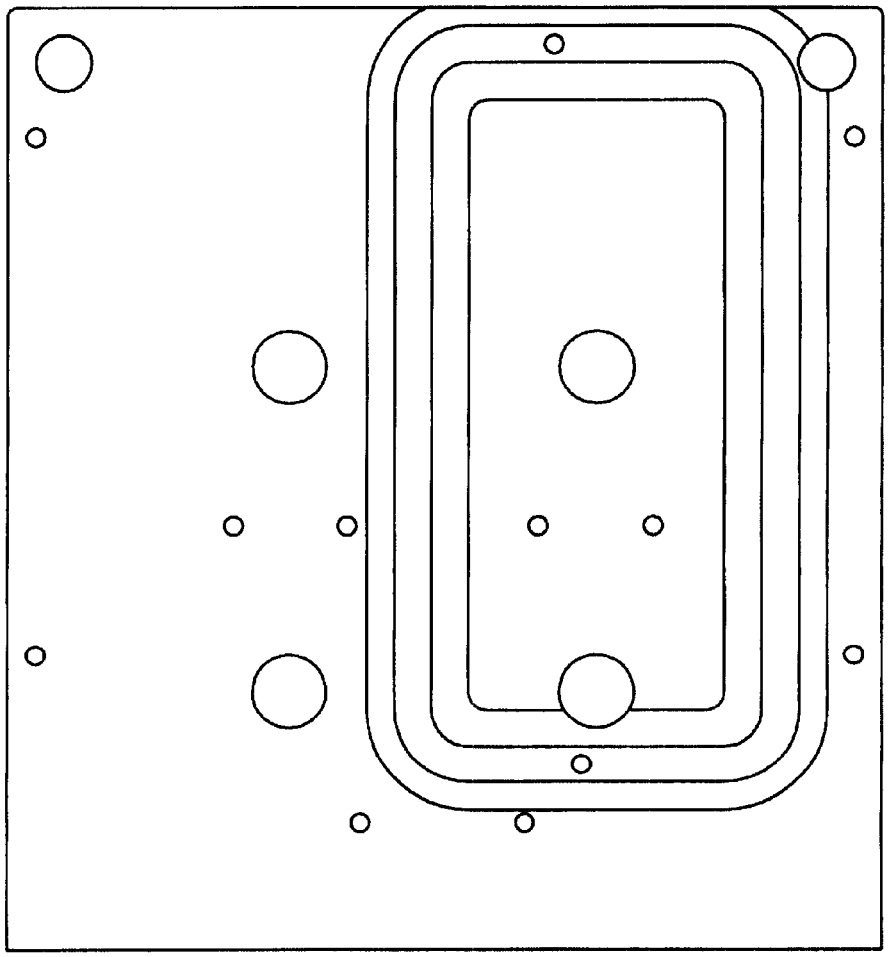

Referring to FIGS. 8 and 9, the lower printed substrate 32 has topologies on opposite surfaces thereof exactly the same as that of the upper printed substrate 30. So, for concision, the lower printed substrate 32 is not described in great detail.

Figure 10:
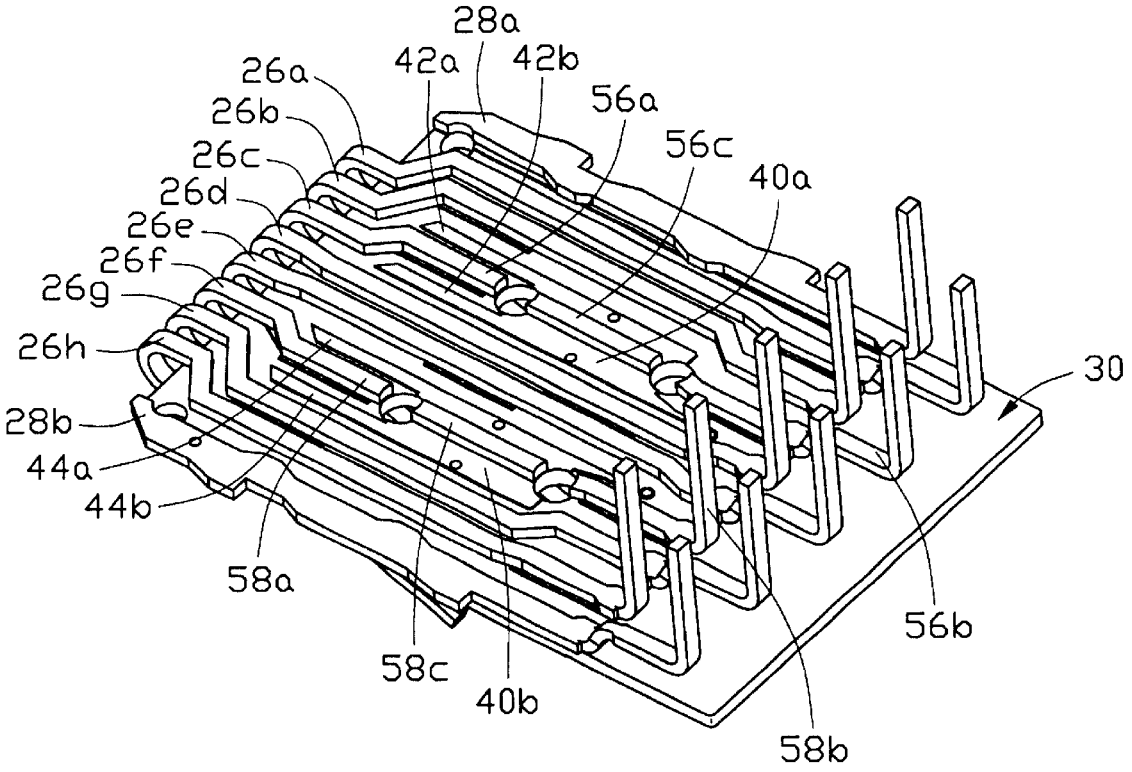
FIG. 10 is an enlarged bottom perspective view of the contact insert while the lower printed substrate is removed to clearly illustrate the attachment of the contacts onto the upper printed substrate.

Now referring to FIG. 10 in conjunction with FIGS. 6 and 7, the two grounding contacts 28*a*, 28*b* which are electrically connected to zero voltage via a grounding trace (not shown) are electrically attached to the conductive bars 46*a*, 46*b*. The signal contacts 26*a*, 26*b* . . . 26*h* are respectively attached to the solder pads 38*a*, 38*b* . . . 38*h*, wherein the signal contact 26*c* is attached to the both solder pads 38*c*, 38*c*' and the signal contact 26*f* is attached to the both solder pads 38*f*, 38*f*'. The signal contact 26*c* is severed into three pieces, designated by a mating portion 56*a*, a mounting portion 56*b* and a middle portion 56*c* between the mating portion 56*a* and the mounting portion 56*b*. The signal contact 26*f* is also severed into three pieces, designated by a mating portion 58*a*, a mounting portion 58*b* and a middle portion 58*c* between the mating portion 58*a* and the mounting portion 58*b*. The mating portion 58*a* is electrically connected to the mounting portion 58*b* through the route between the solder pads 38*f*, 38*f*' as clearly disclosed above. Therefore, signals transmitting through the signal contact 26*f* are rerouted to transmit through the first side section 49*a* and the second side section 49*b* of the middle route 48*b*.

Since the first side section 49*a* of the middle route 48*b* is electrically connected to the signal contact 26*f* and is in spatial registry with the signal contact 26*d*, the capacitance between the signal contacts 26*f* and 26*d* is increased via the first side section 49*a* thereby being balanced with the capacitance between the signal contacts 26*f* and 26*e*. Same conditions happen between the signal contacts 26*f*, 26*g* and 26*h*. When the lower printed substrate 32 mounts to the contacts, same conditions also happen between the signal contacts 26*c*, 26*b* and 26*a*, and the signal contacts 26*c*, 26*d* and 26*e*. Therefore, crosstalk between the signal contacts can be reduced.

As clearly shown in FIG. 10, since the middle portion 58*c* of the signal contact 26*f* is isolated from the mating portion 58*a* and the mounting portion 58*b* and no signal transmits therethrough, the signal contact 26*f* has a short length inducing capacitance with the adjacent signal contacts 26*e* and 26*g*, thereby reducing the capacitance between the signal contact 26*f* and the adjacent signal contacts 26*e* and 26*g*. This is helpful for balancing the capacitance between the signal contact 26*f* and the adjacent signal contacts 26*e* and 26*g* with the capacitance between the signal contact 26*f* and the far away signal contacts 26*d* and 26*h*. Same conditions also happen to the signal contacts 26*a*, 26*b*, 26*c*, 26*d* and 26*e*. Therefore, crosstalk between the signal contacts can be further reduced.

Also as clearly shown in FIG. 10, between the signal contact 26*g* and the mating portion 58*a* of the signal contact 26*f* is the piece of conductive material 44*b*. Since the piece of conductive material 44*b* is connected to zero voltage, it provides a function grounding to reduce the crosstalk between the signal contacts 26*f* and 26*g*. Therefore, crosstalk between the signal contacts can be further reduced.

Also as clearly shown in FIG. 10, the middle section 58*c* of the signal contact 26*f* and the middle section 56*c* of the signal contact 26*c* are connected to zero voltage, thereby providing grounding function. This structure is also helpful for reducing crosstalk between the signal contacts.

Figure 11:
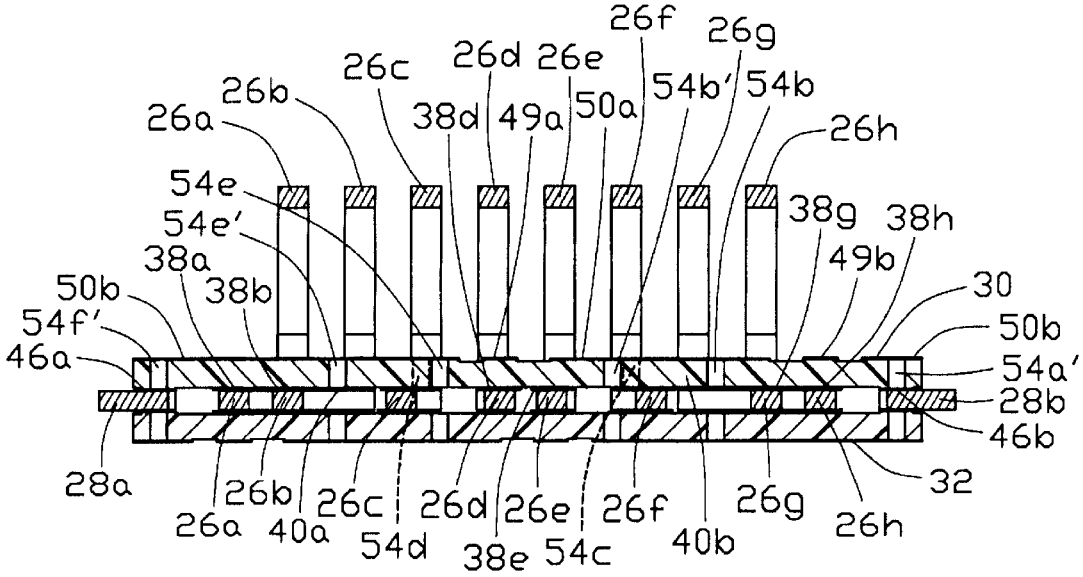
FIG. 11 is a cross-sectional view of the contact insert taken along line XI—XI of FIG. 14.

FIG. 11 illustrates the conductive pads and the vias described above and the contacts arrangement. It is clearly shown that all the signal contacts 26*a*, 26*b* . . . 26*h* and the grounding contacts 28*a*, 28*b* are disposed in a same layer or plane, thereby reducing the thickness of the contact insert 12.

Figure 12:
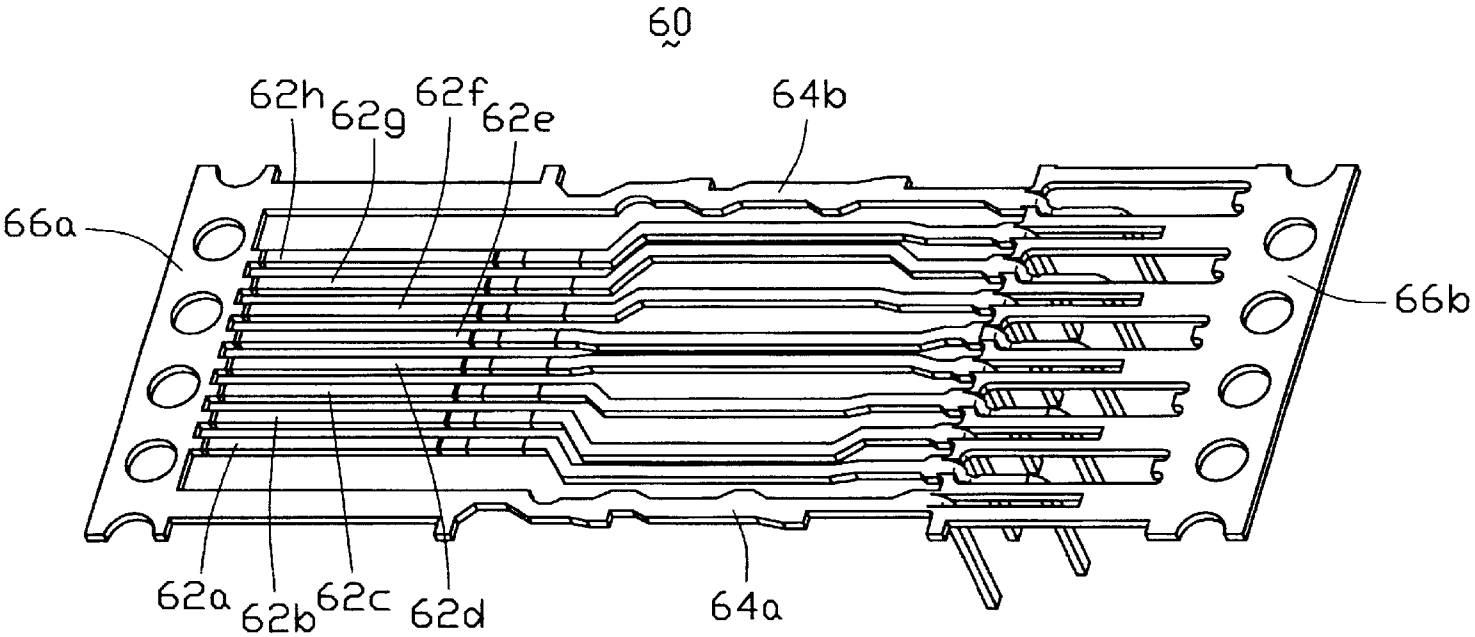
FIG. 12 is a perspective view of a contact carrier stamped and formed during the manufacturing of the modular jack connector.
Figure 13:
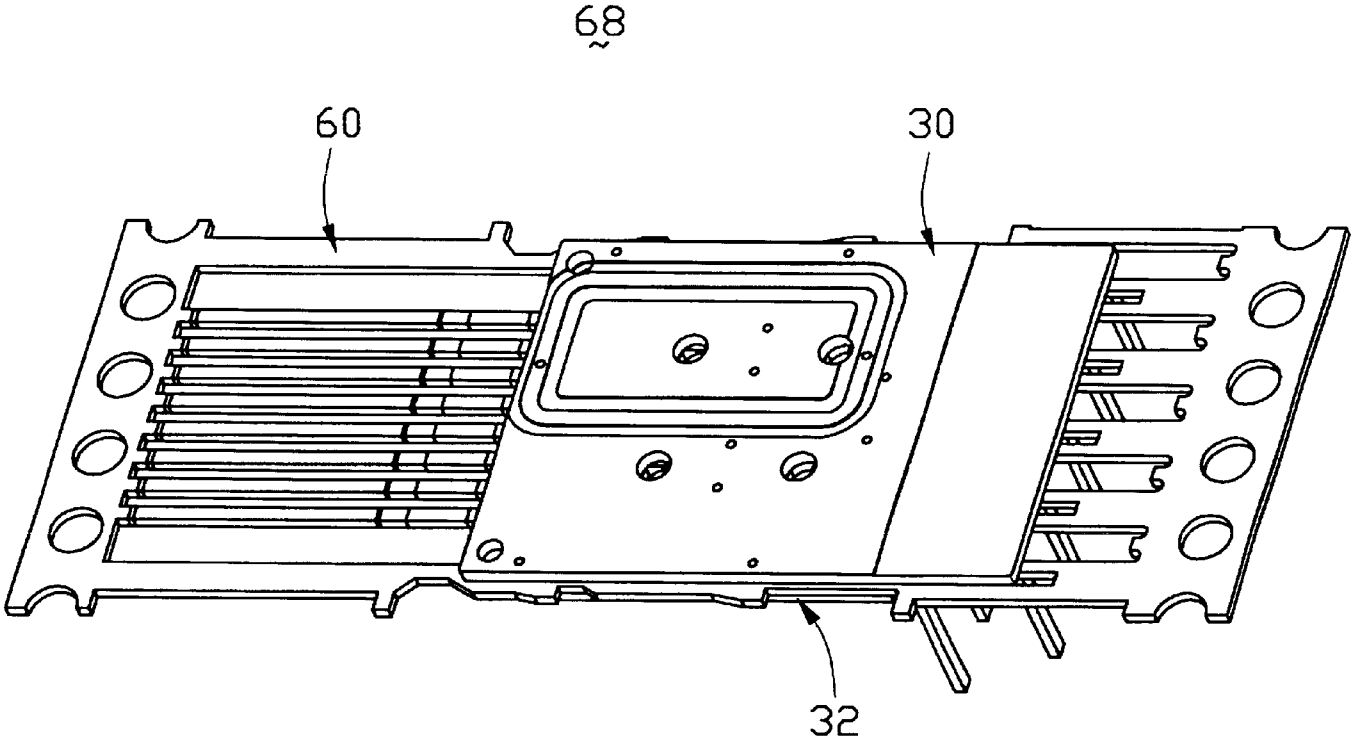
FIG. 13 is a view similar to FIG. 12 while the upper and the lower printed substrates sandwich the contact carrier.
Figure 14:
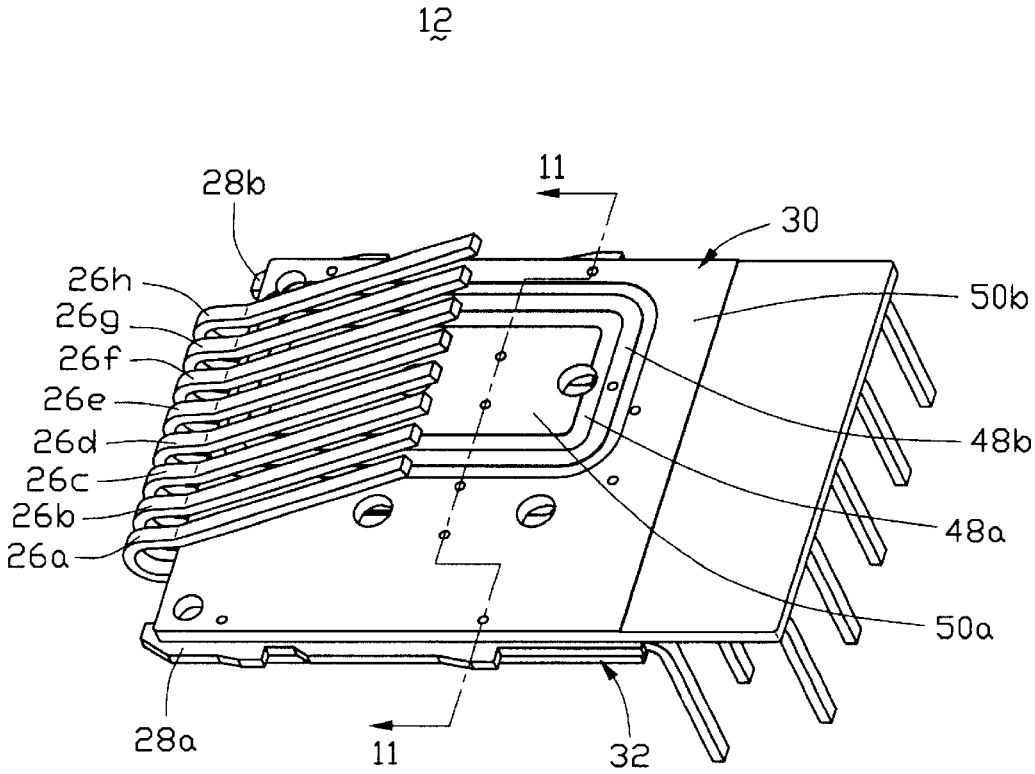
FIG. 14 is a perspective view of the contact insert.

Referring to FIGS. 12-14, during the manufacture of the connector 1, a metal sheet is stamped and formed to form a contact carrier 60 having eight signal pins 62*a*, 62*b* . . . 62*h* arranged side by side and two grounding pins 64*a*, 64*b* disposed at outmost sides thereof, and two pieces of carrier strips 66*a*, 66*b* connecting opposite ends of the signal pins and the grounding pins. The upper and lower printed substrates 30, 32 are securely attached to and sandwich the contact carrier 60 therebetween with the signal pins 62*a*, 62*b* . . . 62*h* and the grounding pins 64*a*, 64*b* electrically connecting corresponding solder pads 38*a*, 38*b* . . . 38*h* on the upper and the lower printed substrates 30, 32. Then a semi-insert 68 is formed, which is shown in FIG. 13. The signal pins 62*c* and 62*f* each are then severed into three pieces. The carrier strips 66*a*, 66*b* are severed from the contact carrier 60 and the signal pins 62*a*, 62*b* . . . 62*h* are reformed to form the contact insert 12. After that, assembling the contact insert 12 to the housing 10.

Figure 15:
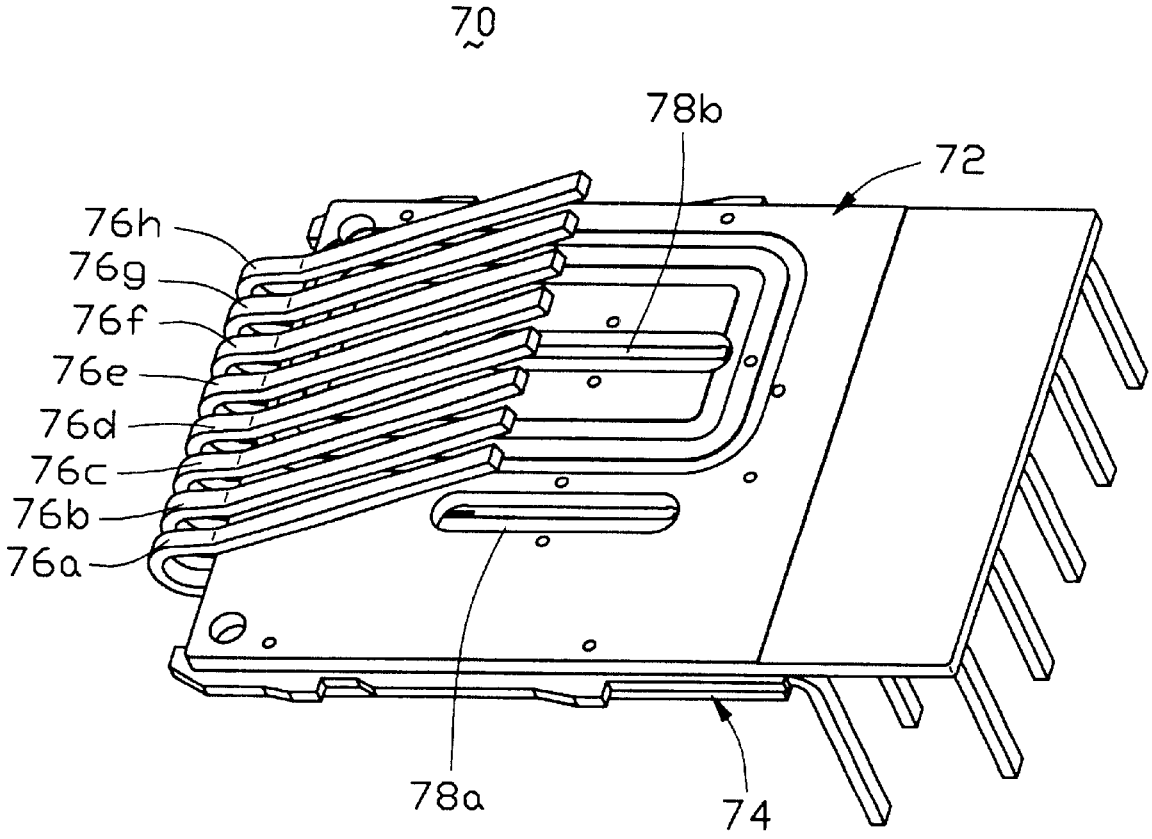
FIG. 15 is a view similar to FIG. 14 but illustrating a second embodiment of the present invention.

Referring to FIG. 15, a second embodiment of the present invention is illustrated. The connector is similar to that of the first embodiment except that a contact insert 70 has a small difference from the contact insert 12 of the first embodiment. The contact insert 70 has an upper printed substrate 72, a lower printed substrate 74 and eight signal terminals, designated by 76*a*, 76*b* . . . 76*h*, arranged side by side and sandwiched between the upper and the lower printed substrates 72, 74. The signal terminals 76*c*, 76*f* each are severed to three pieces and the middle pieces are removed away from the contact insert 70 and leave two elongate slits 78*a*, 78*b*.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing; and a terminal core including:

a substrate with conductive traces thereon;

at least a first, a second and a third contact terminals received in the housing in turn with the second contact terminal being located between the first and the third contact terminal; and a ground conductive element positioned between the second and the third contact terminals to reduce the capacitance between the second and the third contact terminal; wherein each of said terminals defining a slanted contact portion, a vertical solder portion and horizontal connection portion therebetween, all of the connection portions being located on said substrate;

a connection portion of a specific terminal of said terminals being cut out in a middle with an isolated piece between two opposite ends which essentially electrically rejoined and connected via said conductive traces and substantially respectively connect to the contact portion and the solder portion; and an enlarged grounding pad form on said substrate and mechanically and electrically connecting to said isolated piece so as to form an three dimensional grounding bar thereof to reduce crosstalk derived from the neighboring terminals from effecting said specific terminal.

2. The electrical connector as claimed in claim 1, wherein the first, the second and the third contact are attached to a printed circuit board (PCB) and physically and electrically connect corresponding conductive pads on the PCB.

3. The electrical connector as claimed in claim 1 including a first and a second printed circuit board (PCB) respectively having conductive pads and conductive traces thereon, the first and the second PCB sandwiching the first, the second and the third contact therebetween.

4. The electrical connector as claimed in claim 2, wherein the grounded conductive element is printed on the PCB.

5. The electrical connector as claimed in claim 2, wherein the third contact is electrically connected to a conductive trace disposed to be in spatial registry with the first contact to alter capacitance between the third contact and the first contact.

6. The electrical connector as claimed in claim 2, wherein the third contact is severed to reduce the length thereof so as to alter capacitance with the second contact.

7. An electrical connector comprising:

an insulative housing; and a contact insert attached to the housing, the contact insert including a printed circuit board (PCB) having a plurality of conductive pads and conductive traces thereon, and a plurality of contact terminals attached to the respective pads side by side; wherein each of said terminals defining a slanted contact portion, a vertical solder portion and horizontal connection portion therebetween, all of the connection portions being located on said substrate;

a connection portion of a specific terminal of said terminals being cut out in a middle with an isolated piece between two opposite ends which essentially electrically rejoined and connected via said conductive traces and substantially respectively connect to the contact portion and the solder portion; and an enlarged grounding pad form on said substrate and mechanically and electrically connecting to said isolated piece so as to form an three dimensional grounding bar thereof to reduce crosstalk derived from the neighboring terminals from effecting said specific terminal.

8. The electrical connector as claimed in claim 7, wherein a conductive element is positioned between but isolated from the mating portion and the mounting portion of the at least one selected contact and electrically connects to grounding traces of the PCB.

9. The electrical connector as claimed in claim 8, wherein the conductive element is a remainder after severing the at least one selected contact.

10. A method of manufacturing an electrical connector comprising a steps of:

providing an insulative housing:

providing a contact insert, this step including the substeps of:

stamping a sheet of metal to form a contact carrier having a plurality of contact terminals and a carrier strip connecting the contact terminals together, each of said terminals defining a slanted contact portion, a vertical solder portion and horizontal connection portion therebetween, all of the connection portions being located on said substrate;

providing a printed circuit board (PCB) having a plurality of conductive pads and conductive traces connecting selected conductive pads;

electrically connecting the contact terminals to corresponding conductive pads; and providing a connection portion of a specific terminal of said terminals being cut out in a middle with an isolated piece between two opposite ends which essentially electrically rejoined and connected via said conductive traces and substantially respectively connect to the contact portion and the solder portion; and providing an enlarged grounding pad form on said substrate and mechanically and electrically connecting to said isolated piece so as to form an three dimensional grounding bar thereof to reduce crosstalk derived from the neighboring terminals from effecting said specific terminal;

Assembling the contact insert to the housing.

11. The method of manufacturing an electrical connector as claimed in claim 10, wherein the conductive material is a remainder after severing the at least one selected contact.

12. A method of reducing cross talk between electrical contacts in an electrical connector comprising a steps of:

providing a printed circuit board (PCB) having a plurality of conductive pads and conductive traces connecting selected conductive pads, arranging a first and a second differential contact and a third contact side by side, the second contact being locate between the firs and the third contact, each of said contacts defining a first end, a second end and horizontal connection portion therebetween, all of the connection portions being located on said substrate;

providing a connection portion of the third contact being cut out in a middle with an isolated piece between two opposite ends which essentially electrically rejoined and connected via said conductive traces and substantially respectively connect to the contact portion and the solder portion.

13. The method of reducing crosstalk between electrical contacts in an electrical connector as claimed in claim 12 further including a step of extending the conductive element to be in spatial registry with the other contact to alter the capacitance between the third contact and the other contact.

14. The method of reducing crosstalk between electrical contacts in an electrical connector as claimed in claim 12 further including a step of locating a grounded conductive element between the third contact and the adjacent contact to reduce the capacitance between the third contact and the adjacent contact.

15. The method of reducing crosstalk between electrical contacts in an electrical connector as claimed in claim 12 further including a step of locating a grounded conductive element between the first and the second ends of the third contact to reduce the capacitance between the third contact and the adjacent contact.

16. The method of reducing crosstalk between electrical contacts in an electrical connector as claimed in claim 12, wherein the conductive element for electrically connecting the first and the second ends of the third contact is printed on a printed circuit board.

17. An electrical connector comprising:

an insulative housing defining a mating port;

a terminal core disposed in said housing in communication with said mating port;

said terminal core including:

a substrate with conductive traces thereon;

a plurality of juxtaposed terminals thereof, each of said terminals defining a slanted contact portion, a vertical solder portion and a horizontal connection portion therebetween, all of the connection portions being located on said substrate;

a connection portion of a specific terminal of said terminals being cut out in a middle with an isolated piece between two opposite ends which essentially electrically rejoined and connected via said conductive traces and substantially respectively connect to the contact portion and the solder portion; and an enlarged grounding pad formed on said substrate and mechanically and electrically connecting to said isolated piece so as to form a three dimensional grounding bar thereof to reduce crosstalk derived from the neighboring terminals from effecting said specific terminal.

* * * * *